US006413009B1

(12) United States Patent
Duckett

(10) Patent No.: US 6,413,009 B1
(45) Date of Patent: Jul. 2, 2002

(54) VEHICULAR TRAFFIC BARRIER SYSTEM

(75) Inventor: John W. Duckett, Carson City, NV (US)

(73) Assignee: Barrier Systems, Inc., Rio Vista, CA (US)

( * ) Notice: Subject to any disclaimer, the term of this patent is extended or adjusted under 35 U.S.C. 154(b) by 0 days.

(21) Appl. No.: 09/707,501

(22) Filed: Nov. 6, 2000

(51) Int. Cl.[7] ..... E01F 13/00
(52) U.S. Cl. ..... 404/6
(58) Field of Search ..... 404/6; 256/13.1

(56) References Cited

U.S. PATENT DOCUMENTS

| | | | | | |
|---|---|---|---|---|---|
| 4,435,106 | A | * | 3/1984 | Forster et al. | 404/6 |
| 4,474,503 | A | | 10/1984 | Booth et al. | |
| 4,496,264 | A | * | 1/1985 | Casey | 404/6 |
| 4,498,803 | A | | 2/1985 | Quittner | |
| 4,500,225 | A | | 2/1985 | Quittner | |
| 4,553,875 | A | * | 11/1985 | Casey | 404/6 |
| 4,624,601 | A | | 11/1986 | Quittner | |
| 4,681,302 | A | * | 7/1987 | Thompson | 256/13.1 |
| 4,806,044 | A | | 2/1989 | Duckett | |
| 4,815,889 | A | | 3/1989 | Duckett | |
| 4,828,425 | A | | 5/1989 | Duckett | |
| 5,006,010 | A | | 4/1991 | Duckett | |
| 5,118,216 | A | * | 6/1992 | Smith | 404/6 |
| 5,137,391 | A | * | 8/1992 | Ballesteros | 404/6 |
| 5,246,305 | A | | 9/1993 | Peek | |
| 5,253,951 | A | | 10/1993 | Peek | |
| 5,336,016 | A | * | 8/1994 | Baatz | 404/6 |
| 5,387,049 | A | | 2/1995 | Duckett | |
| 5,425,594 | A | * | 6/1995 | Krage et al. | 404/6 |
| 6,059,487 | A | * | 5/2000 | Haga et al. | 404/6 |

OTHER PUBLICATIONS

Barrier Systems Inc. of Rio Vista, CA Sold Under the trademark Quick Change.

* cited by examiner

*Primary Examiner*—Gary S. Hartmann
(74) *Attorney, Agent, or Firm*—Thomas R. Lampe

(57) ABSTRACT

A moveable vehicular traffic barrier system includes pivotally interconnected sections. Each section include a barrier module, hinge elements and resilient bumpers which limit relative pivotal movement between adjacent sections, absorb shock forces and support the barrier module.

26 Claims, 3 Drawing Sheets

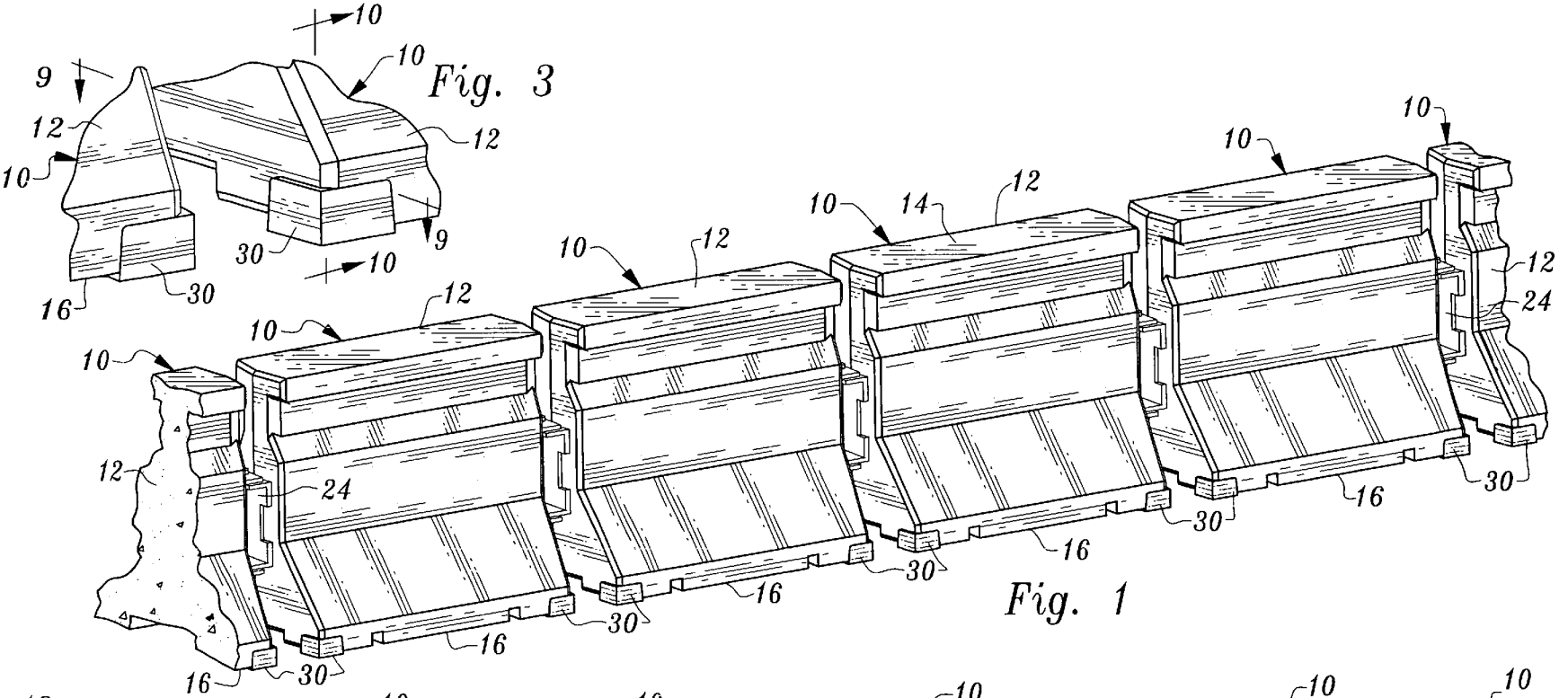
Fig. 1
Fig. 3
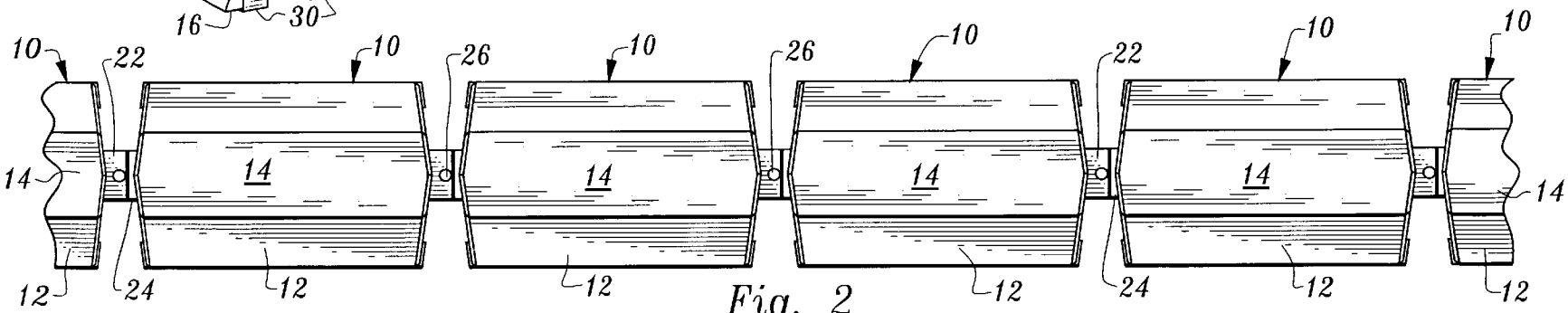
Fig. 2

VEHICULAR TRAFFIC BARRIER SYSTEM

TECHNICAL FIELD

This invention relates to a vehicular traffic barrier system, more particularly, to a barrier comprised of a plurality of pivotally connected barrier system sections which are transferable to different locations on a roadway or other surface.

BACKGROUND OF THE INVENTION

Moveable vehicular traffic barriers or dividers are in widespread usage. Some of these systems incorporate a plurality of sections including concrete barrier modules which are pivotally interconnected by hinges and disposed end to end. Exemplary moveable barrier systems of this latter type are made available by Barrier Systems Inc. of Rio Vista, Calif. and sold under the registered trademark Quick Change. Applicant is also aware of the following United States patents which relate to lane barrier systems and related structures: U.S. Pat. No. 4,624,601, issued Nov. 25, 1986, U.S. Pat. No. 4,498,803, issued Feb. 12, 1985, U.S. Pat. No. 4,500,225, issued Feb. 19, 1985, U.S. Pat. No. 4,474,503, issued Oct. 2, 1984, U.S. Pat. No. 4,806,044, issued Feb. 21, 1989, U.S. Pat. No. 4,815889, issued Mar. 28, 1989, U.S. Pat. No. 4,828,425, issued May 9, 1989, U.S. Pat. No. 5,006,010, issued Apr. 9, 1991, U.S. Pat. No. 5,246,305, issued Sep. 21, 1993, U.S. Pat. No. 5,253,951, issued Oct. 19, 1993, and U.S. Pat. No. 5,387,049, issued Feb. 7, 1995.

Moveable barrier systems featuring pivotally interconnected sections can sustain structural damage when struck and deflected by an automobile or other vehicle. One type of damage that can occur is breakage at the corners of the modules when they are deflected or moved in such a way as to bring the corners of adjacent modules into direct contact.

DISCLOSURE OF INVENTION

The present invention relates to an approach which inexpensively, efficiently and effectively reduces corner breakage on moveable barrier system sections when they are deflected, adding to the durability of the sections.

A vehicular traffic barrier system constructed in accordance with the teachings of the present invention includes a plurality of pivotally interconnected sections generally disposed end to end. Each section includes a barrier module having a top, a bottom, a pair of side walls and a pair of end walls.

Hinge elements are located at the end walls of the barrier module connecting the section to adjacent sections.

At least one resilient bumper is connected to the barrier module extending outwardly from each of the end walls thereof for engaging adjacent sections to limit relative pivotal movement therebetween and to absorb shock forces caused by the relative pivotal movement.

Other features, advantages, and objects of the present invention will become apparent with reference to the following description and accompanying drawings.

BRIEF DESCRIPTION OF DRAWINGS

FIG. 1 is a perspective view illustrating a portion of a vehicular traffic barrier system constructed in accordance with the teachings of the present invention and including a plurality of pivotally interconnected sections disposed end to end;

FIG. 2 is a top plan view of the portion of the vehicular traffic barrier system shown in FIG. 1;

FIG. 3 is a perspective, detail view of the lower corners of two adjacent sections, each corner having a resilient bumper associated therewith;

BEST MODE FOR CARRYING OUT THE INVENTION

Figures 4, 5, 6:
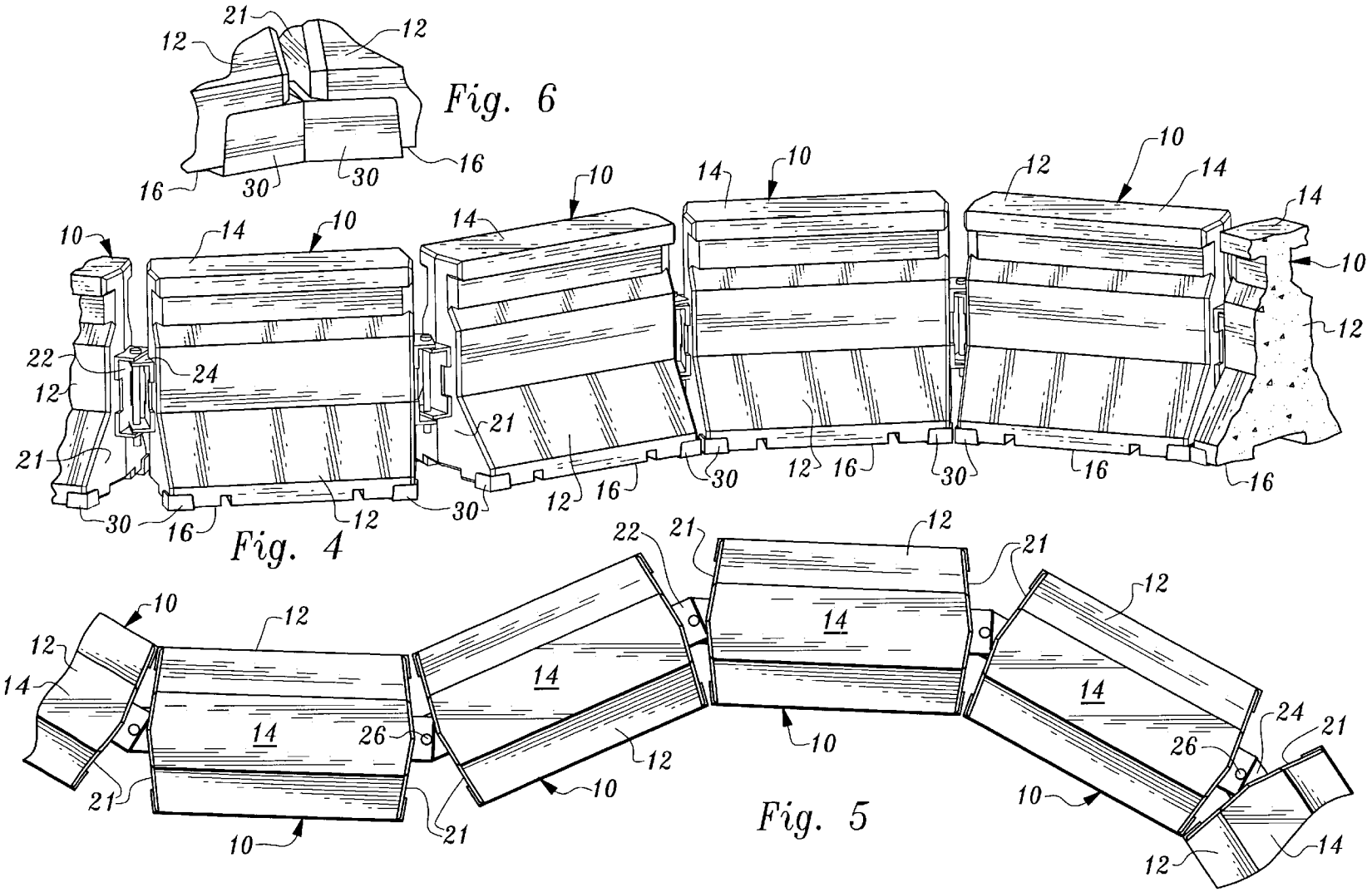
FIG. 4 is a view similar to FIG. 1 but illustrating the vehicular traffic barrier system in a deflected condition, as caused, for example, by having been struck by a vehicle.
FIG. 5 is a plan view of the deflected barrier system portion shown in FIG. 4.
FIG. 6 is a view similar to FIG. 3, but showing bumpers associated with adjacent deflected barrier system sections in engagement.
Figure 10:
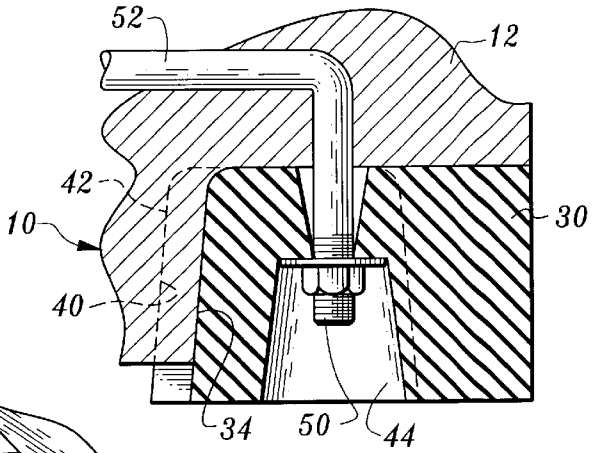
FIG. 10 is a greatly enlarged cross-sectional view taken along line 10—10 of FIG. 3 and showing structural details relating to a bumper and the means of attachment thereof to the barrier module.
Figure 9:
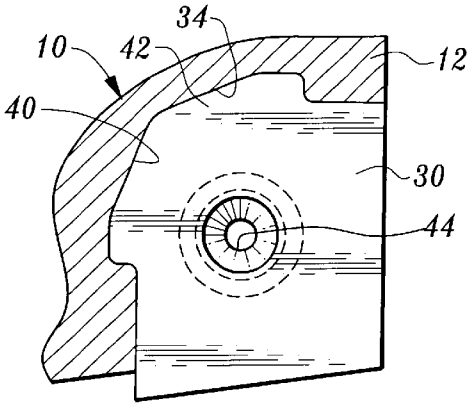
FIG. 9 is a greatly enlarged cross-sectional view taken along line 9—9 of FIG. 3 and showing a bumper and surrounding structure of the module.
Figure 7:
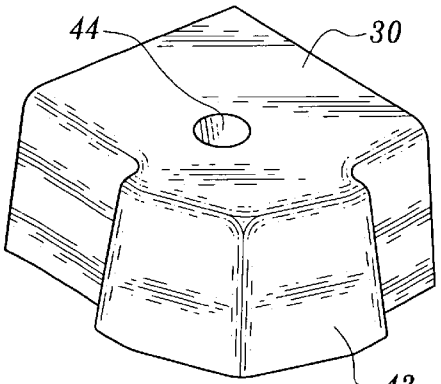
FIG. 7 is a perspective view of a bumper.
Figure 8:
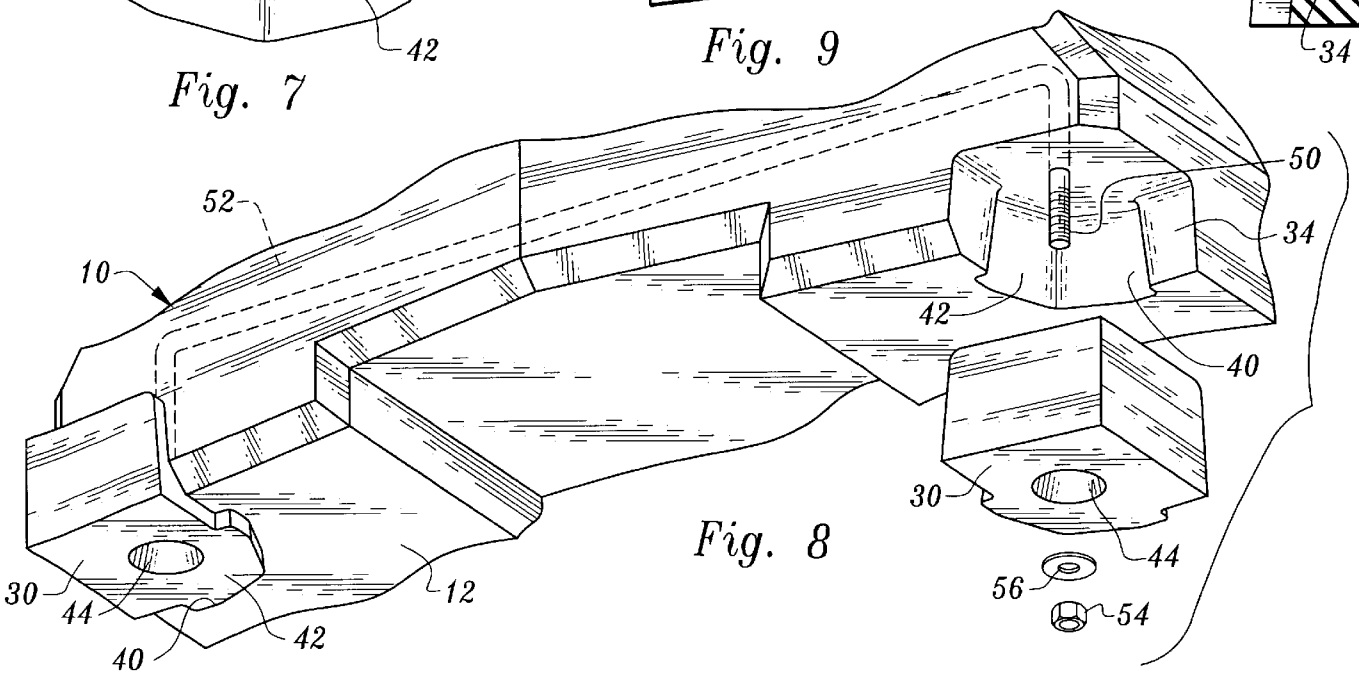
FIG. 8 is a bottom, perspective view showing one bumper installed on an end of a section module and one bumper and related components prior to installation on the module.

Referring now to the drawings, a moveable vehicular traffic barrier system constructed in accordance with the teachings of the present invention includes a plurality of vehicular traffic barrier system sections disposed end to end.

Each section 10 includes a barrier module 12 having a top 14, a bottom 16, a pair of side walls 18 and a pair of end walls 20. End walls 20 are generally V-shaped as viewed from the top or bottom and include two end wall surface portions 21 angularly disposed relative to one another. The illustrated barrier modules 12 are suitably formed of reinforced concrete.

Hinge elements 22, 24 are located at the centers of the end walls of the barrier modules and are cooperable with a hinge pin 26 to hingedly connect the sections 10 to adjacent sections. When the sections 10 are pivotally interconnected they form an articulated string that can be moved by suitable commercially available equipment utilized for such purpose.

FIGS. 1 and 2 show a plurality of sections 10 coaxially disposed and forming a straight line. In FIGS. 4 and 5, on the other hand, these sections have been displaced and in the configuration illustrated form a double curve. Such deflection may, for example, have been caused by the impact of a vehicle or perhaps may have taken place during the barrier moving operation.

It will be appreciated that if the deflection of the vehicular traffic barrier system sections 10 is great enough, the corners of at least some of the sections will be brought into engagement. This can result in breakage of the barrier modules at the locations of engagement. The problem is somewhat exacerbated by the fact that barrier sections of this type can have considerable weight, often approaching or even exceeding fifteen hundred pounds for each barrier element or section.

It is an objective of the present invention to reduce or in some cases even eliminate such damage. In the illustrated embodiment of the invention each section 10 includes four resilient bumpers 30 connected to the barrier module thereof and extending outwardly from each of the end walls thereof. The bumpers may be formed of any suitable resilient material such as rubber or an elastomeric material having the desired characteristics. A suitable representative material for formation of the bumpers is truck tire tread material having a Durometor Scale A hardness of about 60.

Two bumpers 30 extend outwardly from each of the end walls of a section 10, the bumpers being spaced from one another. The bumpers are located at the side walls of their respective barrier modules and also project downwardly from the bottoms of the barrier modules to support the modules on a roadway or other surface (not shown).

The resilient bumpers 30 are positioned in cavities 34 defined by the barrier modules 12 at the four corners thereof. The resilient bumpers limit relative pivotal movement between the adjacent hingedly interconnected sections 10 when they are deflected and also serve to absorb shock forces caused by the relative pivotal movement so that such shock forces are not applied directly to the concrete barrier modules. The bumpers 30 have substantially planar contact surfaces which parallel the angled end surface portions 21 of the modules with which they are associated so that the substantially planar contact surfaces of adjacent bumpers are placed in substantially full engagement when in contact to distribute forces.

The bumpers are in frictional engagement with their respective barrier modules. Each of the cavities 34 has an inner cavity wall having a predetermined cross-sectional shape and the bumpers received by the cavities have an outer bumper wall of essentially the same cross-section. It will be noted that the cavities include recesses 40 receiving correspondingly shaped protrusions 42 on the bumpers.

The bumpers 30 are preferably solid except for bumper openings 44 formed therein. The bumper openings 44 receive threaded ends 50 of concrete reinforcement bars 52 extending through the barrier modules closely adjacent to the ends thereof. Nuts 54 and washers 56 are employed to retain the bumpers in place on the reinforcement bars and in the cavities 34.

What is claimed is:

1. A vehicular traffic barrier system section for connection end to end with at least one other vehicular traffic barrier system section to form an elongated vehicular traffic barrier system and comprising, in combination:

a barrier module having a top, a bottom, a pair of side walls and a pair of end walls extending between and adjoining said side walls;

hinge elements located at the end walls of said barrier module for hingedly connecting the vehicular traffic barrier system section to adjacent vehicular traffic barrier system sections; and resilient bumpers connected to said barrier module extending outwardly from the end walls thereof adjacent to the side walls thereof for engaging resilient bumpers extending outwardly from end walls of adjacent vehicular traffic barrier system sections when hingedly connected thereto by said hinge elements to limit relative pivotal movement therebetween, prevent engagement between the end walls of said barrier module and end walls of barrier modules of adjacent vehicular traffic barrier system sections and to absorb shock forces caused by said relative pivotal movement, at least one of said resilient bumpers projecting forwardly from one of the end walls and at least one of said resilient bumpers projecting downwardly from the other of the end walls.

2. The vehicular traffic barrier system section according to claim 1 wherein a plurality of resilient bumpers extend outwardly from each of the end walls of said barrier module and are spaced from one another.

3. The vehicular traffic barrier system section according to claim 2 wherein the resilient bumpers extending outwardly from each of the end walls are located at the side walls of said barrier module.

4. The vehicular traffic barrier system section according to claim 2 wherein the resilient bumpers extending outwardly from each of the end walls are located at the bottom of said barrier module and project downwardly from said bottom for supporting said barrier module on a roadway or other surface.

5. The vehicular traffic barrier system section according to claim 2 wherein said barrier module defines cavities receiving said plurality of resilient bumpers, the resilient bumpers received in said cavities being in frictional engagement with said barrier module.

6. The vehicular traffic barrier system section according to claim 5 additionally comprising bumper holder means attached to said barrier module and extending into said cavities, the resilient bumpers received in said cavities defining bumper openings accommodating said bumper holder means.

7. The vehicular traffic barrier system section according to claim 6 wherein said bumper holder means comprises a plurality of support shafts affixed to said barrier module and extending into said bumper openings.

8. The vehicular traffic barrier system section according to claim 6 wherein said barrier module is formed from concrete and wherein said bumper holder means comprises at least one concrete reinforcement bar extending through the barrier module.

9. The vehicular traffic barrier system section according to claim 8 wherein said at least one concrete reinforcement bar has threaded ends comprising support shafts, said vehicular traffic barrier system section additionally comprising connectors threadedly connected to said threaded ends and retaining resilient bumpers at said threaded ends.

10. The vehicular traffic barrier system section according to claim 5 wherein each of said cavities has an inner cavity wall having a predetermined cross-sectional shape and wherein the resilient bumpers received by said cavities have outer bumper walls with a generally correspondingly shaped cross-section.

11. The vehicular traffic barrier system section according to claim 10 wherein said cavities include recesses receiving correspondingly shaped protrusions of resilient bumpers received by said cavities.

12. The vehicular barrier system section according to claim 1 wherein said at least one resilient bumper has a substantially planar contact surface for engaging a substantially planar contact surface of a resilient bumper on an adjacent vehicular traffic barrier system section during relative pivotal movement therebetween.

13. The vehicular traffic barrier system section according to claim 1 wherein each of said end walls includes end wall surface portions angularly disposed relative to one another.

14. A vehicular traffic barrier system including a plurality of pivotally interconnected vehicular traffic barrier system sections generally disposed end to end, each vehicular traffic barrier system section comprising, in combination:

a barrier module having a top, a bottom, a pair of side walls and a pair of end walls extending between and adjoining said side walls;

hinge elements located at the end walls of said barrier module hingedly connecting said vehicular traffic system section to adjacent vehicular traffic barrier system sections; and resilient bumpers connected to said barrier module extending outwardly from the end walls thereof adjacent to the side walls thereof for engaging resilient bumpers extending outwardly from end walls of adjacent vehicular traffic barrier system sections hingedly connected thereto by said hinge elements to limit relative pivotal movement therebetween, prevent engagement between the end walls of said barrier module and end walls of barrier modules of adjacent vehicular traffic barrier system sections and to absorb shock forces caused by said relative pivotal movement, at least one of said resilient bumpers connected to said barrier module projecting forwardly from one of the end walls thereof and at least one of said resilient bumpers connected to said barrier module projecting rearwardly from the other of the end walls thereof.

15. The vehicular traffic barrier system according to claim 14 wherein a plurality of resilient bumpers extend outwardly from each of the end walls of the barrier module of each vehicular traffic barrier system section and are spaced from one another.

16. The vehicular traffic barrier system according to claim 15 wherein the resilient bumpers extending outwardly from each of the end walls of each vehicular traffic barrier system section are located at the side walls of the barrier module thereof.

17. The vehicular traffic barrier system according to claim 15 wherein the resilient bumpers extending outwardly from each of the end walls of each vehicular traffic barrier system section are located at the bottom of the barrier module thereof and project downwardly from said bottom for supporting the barrier module thereof on a roadway or other surface.

18. The vehicular traffic barrier system according to claim 15 wherein the barrier module of each vehicular traffic barrier system section defines cavities receiving said plurality of resilient bumpers, the resilient bumpers received in said cavities being in frictional engagement with the barrier module thereof.

19. The vehicular traffic barrier system according to claim 18 wherein each vehicular traffic barrier system section additionally comprises bumper holder means attached to the barrier module thereof and extending into the cavities defined thereby, the resilient bumpers received in the cavities thereof defining bumper openings accommodating said bumper holder means.

20. The vehicular traffic barrier system according to claim 19 wherein said bumper holder means comprises a plurality of support shafts affixed to said barrier module and extending into said bumper openings.

21. The vehicular traffic barrier system according to claim 19 wherein the barrier module of each vehicular traffic barrier system section is formed from concrete and wherein said bumper holder means comprises at least one concrete reinforcement bar extending through the barrier module of each vehicular traffic barrier system section.

22. The vehicular traffic barrier system according to claim 21 wherein said at least one concrete reinforcement bar has threaded ends comprising support shafts, each said vehicular traffic barrier system section additionally comprising connectors threadedly connected to said threaded ends and retaining resilient bumpers at said threaded ends.

23. The vehicular traffic barrier system according to claim 18 wherein each of said cavities has an inner cavity wall having a predetermined cross-sectional shape and wherein the resilient bumpers received by said cavities have outer bumper walls with a generally correspondingly shaped cross-section.

24. The vehicular traffic barrier system according to claim 23 wherein said cavities include recesses receiving correspondingly shaped protrusions of resilient bumpers received by said cavities.

25. The vehicular traffic barrier system according to claim 14 wherein at least one of said resilient bumpers has a substantially planar contact surface for engaging a substantially planar contact surface of a resilient bumper of an adjacent vehicular traffic barrier system section during relative pivotal movement therebetween.

26. The vehicular traffic barrier system according to claim 14 wherein each of said end walls includes end wall surface portions angularly disposed relative to one another.

* * * * *